United States Patent [19]

Doak

[11] 4,397,104

[45] Aug. 9, 1983

[54] INFLATABLE SOLE-SHOE

[76] Inventor: Clayton R. Doak, 5540 Navajo Trail, Silver Springs, Nev. 89429

[21] Appl. No.: 227,831

[22] Filed: Jan. 23, 1981

[51] Int. Cl.[3] ..... A43B 13/20; A43B 7/08; A43B 21/28

[52] U.S. Cl. ..... 36/29; 36/3 B; 36/35 B

[58] Field of Search ..... 36/29, 28, 3 R, 3 B, 36/44, 35 B

[56] References Cited

U.S. PATENT DOCUMENTS 4,229,889 10/1980 Petrosky ..... 36/29 X
4,319,412 3/1982 Muller et al. ..... 36/29

FOREIGN PATENT DOCUMENTS 32084 7/1981 European Pat. Off. ..... 36/35 B
806647 5/1952 Fed. Rep. of Germany ..... 36/29
2460034 6/1976 Fed. Rep. of Germany ..... 36/29
52-2646 1/1977 Japan ..... 36/3 B
13911 of 1892 United Kingdom ..... 36/29

*Primary Examiner*—James Kee Chi
*Attorney, Agent, or Firm*—Howard I. Podell

[57] ABSTRACT

A shoe fitted with an inflatable sole. One or more air valves joined to the shoe permit inflating the interior of the sole to a desired pressure of air proportional to the weight of the wearer of the shoe. The sole is formed of an upper liner joined to a lower liner along their respective common periphery, with a plurality of spaced resilient pegs joined between the said liners in the interior so as to maintain the said liners in alignment with the sole inflated, and to provide a uniform air pressure throughout the interior of the sole. Alternatively the sole may be formed of a solid section of flexible or elastomeric material formed with a plurality of intersecting through longitudinal and transverse cylindrical air passages joined to one or more valves.

3 Claims, 8 Drawing Figures

INFLATABLE SOLE-SHOE

BACKGROUND OF THE INVENTION

It is well known to form a shoe with one or more spaced air pockets, as disclosed in U.S. Pat. Nos. 3,253,355; 3,914,881; 4,133,118; 2,968,105; 4,170,078; 2,100,492; 4,129,951; 302,190 and 4,012,855.

However, none of these patents suggest the effectiveness and simplicity of my invention nor the comfort to the user achieved in wearing a shoe of my invention, as described herein.

SUMMARY OF THE INVENTION

My invention is a shoe fitted with an inflatable sole. One or more air valves joined to the sole permit inflating the interior of the sole to a desired pressure of air proportional to the weight of the wearer of the shoe. The sole is formed of an upper liner joined to a lower liner along their respective common periphery, with a plurality of spaced resilient pegs joined between the said liners in the interior so as to maintain the said liners in alignment, with the sole inflated, and to provide a uniform air pressure throughout the interior of the sole. Alternatively the sole may be formed of a solid section of flexible or elastomeric material formed with a plurality of through intersecting longitudinal and transverse cylindrical air passages joined to one or more valves.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFFERRED EMBODIMENT

Figure 1:
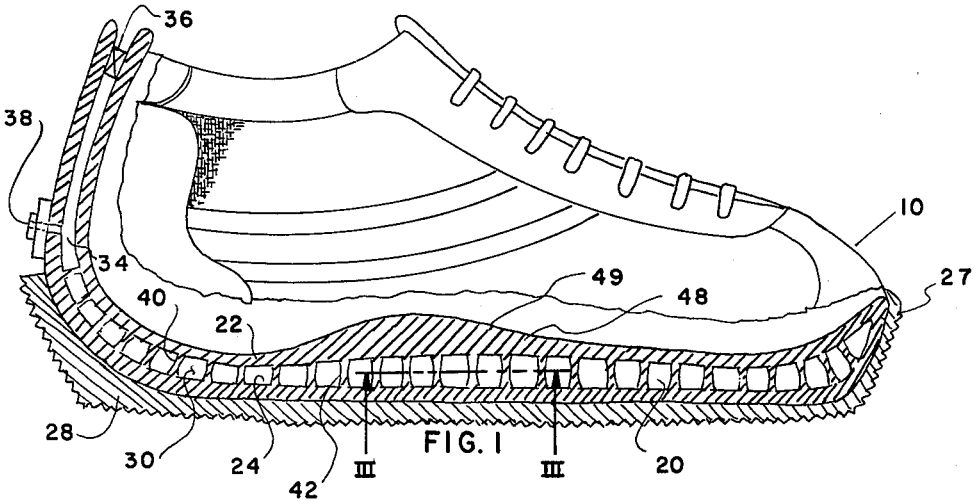
FIG. 1 is a sectional view of a shoe of my invention, in side view.

Turning now descriptively to the drawings, in which similar reference characters denote similar elements throughout the several views, FIGS. 1, 3, 5 and 8 illustrate the shoe 10 formed with a sole 20 bounded by an upper flexible liner 22 and a lower flexible liner 24 spaced apart by a continuous air chamber 30. A section of flexible tread material 28 is externally bonded to the lower liner. The upper and lower liners are joined at their periphery 27.

The interior chamber 30 is joined by an air passageway 34 mounted along the rear of the shoe terminating in an air valve 36 for use in inflating the chamber 30 with air under a desired pressure. A second valve 38 may optionally be mounted to the passageway 34 at the rear of the heel section of the shoe. Valves 36 and 38 may be of any conventional type such as those employed in footballs to permit attachment of an external pressurized air supply line, or a tube from an air pump and valves 38 and 36 permit deflation of air from chamber 30 as desired.

The upper and lower liners are spaced apart from each other and maintained in alignment by a plurality of pegs 40 formed of elastomeric material such as rubber, each of which is fastened at its base to the lower liner and at its apex to the upper liner. Preferably the pegs are of a reduced cross-section at an intermediate section 42 to provide optimum flexibility of the peg while providing a larger sufficient area of bonding at the apex and base of each peg to the upper and lower liners respectively so as to maintain the upper and lower liners in alignment both longitudinally laterally. The vertical spacing between the liners is a function of the height of the pegs and the pressure of air in chamber 30.

Upper liner 22 may be shaped with an instep section 48 that is shaped with a convex upper surface 49 so as to provide comfortable support to the concave arch section of a user's foot.

Figure 2:
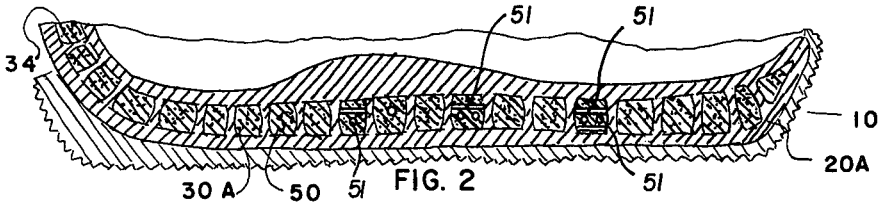
FIG. 2 is a detail side sectional view of an alternative embodiment.
Figure 3:
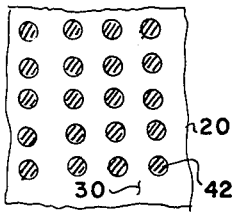
FIG. 3 is a detail sectional view in plan view of the sole, taken along line 3—3 of FIG. 1.

An alternative embodiment of the invention is shown in FIG. 2 in which a sole 20A is formed in a similar shape to that of sole 20 disclosed in FIG. 1. The chamber 30A of sole 20A is fitted with a porous mesh material 50 of a flexible material such as sponge rubber, or nylon or other plastic. Tubular holes 51 may extend laterally and longitudinally through the mesh material so as to provide an interconnecting plurality of passages for air to flow so that air inflated through valve passage 34 will provide a common fluid cushion at a common pressure through the interior passageways in the mesh material 50 and tubular holes 51.

Figure 4:
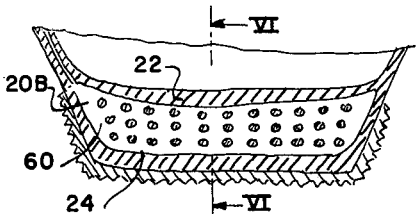
FIG. 4 is a detail sectional side view of a second alternative embodiment of my invention.
Figure 6:
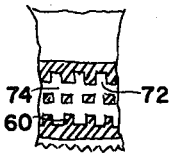
FIG. 6 is a detail plan sectional view of the alternative embodiment of FIG. 4 taken along line 6—6 of FIG. 4.
Figure 7:
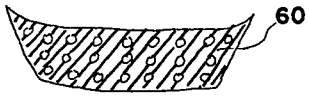
FIG. 7 is a side sectional view of the sole of the alternative embodiments.
Figure 5:
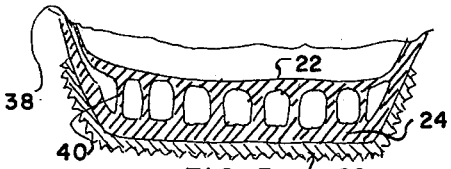
FIG. 5 is an end sectional view of the sole of FIG. 1.
Figure 8:
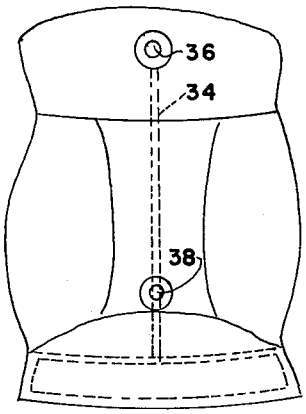
FIG.8 is a rear elevation view of the sole of my invention.

A further alternative embodiment of the invention is shown in FIGS. 4, 6 and 7. A sole 20B is formed with an elastomeric material pad 60 such as rubber or a flexible plastic bonded to upper and lower linings 22 and 24. Tubular holes 72 extend longitudinally and similar tubular holes 74 extend transversely through pad 60 to interconnect with each other and with the inlet valve passageway 34 so that air may be inflated under pressure through a valve 36 or 38 into said tubular holes to provide a cushion of air at a common pressure throughout the pad 60.

The vertical spacing between the upper and lower linings may be increased by use of a thicker pad 60 to provide for a sole of desirable thickness.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A shoe comprising a shoe body and an inflatable sole, said inflatable sole comprising a sole assembly to which the said shoe body is attached, said sole assembly comprising an upper lining, a lower lining, means for attaching said linings to each other about their common periphery, flexible means to space said lower lining spaced apart from said upper lining so as to provide a continuous passageway for air along the length and width of said sole, said flexible means consisting of a plurality of spaced flexible pegs, each peg being bonded to at least one of said linings and extending to the other, said pegs having an intermediate section of reduced cross-section relative to the end sections thereof; and an inlet valve connected to said continuous passageway so that the passageway may be inflated with air under a common pressure for the length and width of the sole.

2. The invention as recited in claim 1 in which each said peg is bonded to both the upper and the lower linings.

3. The invention as recited in claim 1 in which porous flexible mesh material is mounted in the continuous passageway.

* * * * *